US009919362B2

(12) United States Patent
Girardini et al.

(10) Patent No.: US 9,919,362 B2
(45) Date of Patent: Mar. 20, 2018

(54) PROCEDURE FOR THE MECHANICAL ALLOYING OF METALS

(71) Applicant: K4SINT, S.r.l., Pergine Valsugana (IT)

(72) Inventors: Luca Girardini, Pergine Valsugana (IT); Mario Zadra, Pergine Valsugana (IT)

(73) Assignee: K4SINT S.R.L., Pergine Valsugana (IT)

( * ) Notice: Subject to any disclaimer, the term of this patent is extended or adjusted under 35 U.S.C. 154(b) by 107 days.

(21) Appl. No.: 14/780,407

(22) PCT Filed: Mar. 28, 2014

(86) PCT No.: PCT/IB2014/060275

§ 371 (c)(1),
(2) Date: Sep. 25, 2015

(87) PCT Pub. No.: WO2014/155359

PCT Pub. Date: Oct. 2, 2014

(65) Prior Publication Data

US 2016/0039007 A1 Feb. 11, 2016

(30) Foreign Application Priority Data

Mar. 29, 2013 (IT) ..... MO2013A0084

(51) Int. Cl.

| | |
|---|---|
| ***B22F 9/04*** | (2006.01) |
| ***C22C 14/00*** | (2006.01) |
| ***C22C 16/00*** | (2006.01) |
| ***C22C 19/00*** | (2006.01) |
| *C22C 21/00* | (2006.01) |

(52) U.S. Cl.

CPC ..... *B22F 9/04* (2013.01); *C22C 14/00* (2013.01); *C22C 16/00* (2013.01); *C22C 19/007* (2013.01); *B22F 2009/041* (2013.01); *B22F 2009/043* (2013.01); *C22C 21/00* (2013.01)

(58) Field of Classification Search

None

See application file for complete search history.

(56) References Cited

U.S. PATENT DOCUMENTS

| | | | | |
|---|---|---|---|---|
| 3,785,801 | A * | 1/1974 | Benjamin | B22F 9/04 419/1 |
| 6,231,636 | B1 | 5/2001 | Froes et al. | |
| 2006/0099432 | A1 * | 5/2006 | Keener | B22F 1/0044 428/457 |
| 2009/0107294 | A1 * | 4/2009 | Nishioka | B22F 9/082 75/338 |
| 2009/0169869 | A9 * | 7/2009 | Hirai | B22F 9/04 428/330 |
| 2009/0278086 | A1 * | 11/2009 | Fruchart | B22F 9/04 252/182.33 |

FOREIGN PATENT DOCUMENTS

| | | | |
|---|---|---|---|
| JP | H08193202 | A | 7/1996 |
| JP | 2000265226 | A | 9/2000 |
| JP | 2004059961 | A | 2/2004 |
| WO | 2011091449 | A1 | 7/2011 |

OTHER PUBLICATIONS

English translation of JP 08-193202 (published Jul. 30, 1996), from J-PlatPat.*

English translation of JP 2000-265226 (published Sep. 26, 2000), from J-PlatPat.*

English translation of JP 2004-059961 (published Feb. 26, 2004), from J-PlatPat.*

International Search Report dated Aug. 25, 2014 from International Patent Application No. PCT/IB2014/060275, filed Mar. 28, 2014.

International Preliminary Report on Patentability dated Sep. 29, 2015 from International Patent Application No. PCT/IB2014/060275, filed Sep. 25, 2015.

* cited by examiner

*Primary Examiner* — George Wyszomierski

(74) *Attorney, Agent, or Firm* — Sunstone IP

(57) ABSTRACT

The procedure for the mechanical alloying of metals comprises grinding at least a metal inside a grinding mill together with at least a control agent to obtain a powdered ground product, wherein: —the metal is selected from the list comprising: titanium, zirconium, hafnium, vanadium, niobium, tantalum, chromium, molybdenum, tungsten; and—the control agent is selected from the list comprising: magnesium, calcium and rare earths.

18 Claims, 1 Drawing Sheet

Fig. 1
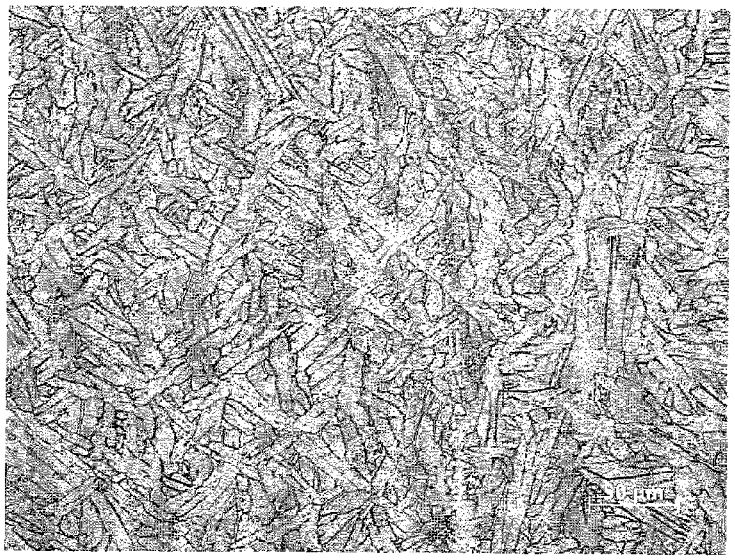
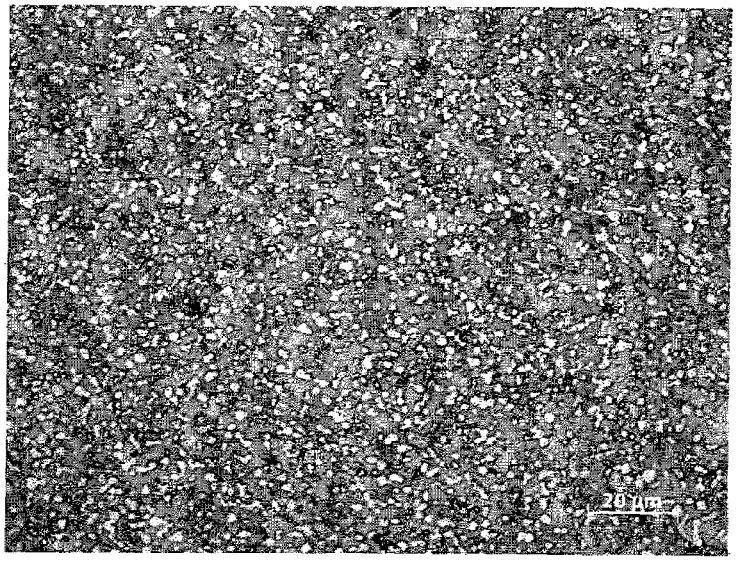
Fig. 2

PROCEDURE FOR THE MECHANICAL ALLOYING OF METALS

TECHNICAL FIELD

The present invention relates to a procedure for the mechanical alloying of metals.

BACKGROUND ART

It is known that mechanical alloying is a solid-state process which uses the continuous fracturing and cold welding of powder particles to obtain the intimate aggregation of their atoms.

Such process consists in grinding material inside specific grinding mills: ball mills, planetary mills, attritor mills, gravity mills, vibration mills, which usually use balls as grinding means.

Once ground, the powdery material can be compacted in specific moulds and sintered to obtain the finished product.

Irrespective of the method and of the type of mill, during the grinding process a continuous and repetitive operation occurs involving the welding and fracturing of the powder particles which over time determines the total uniformity up to atomic level of the treated material.

In the case of alloy elements being introduced inside the mill which are different from one another, an alloy can be obtained in powder state in which the atoms of the different materials are intimately bonded to each other.

We nevertheless continue to speak of "mechanical alloying" even in the case of only one material being introduced inside the mill, in which case, the mechanical alloying process is aimed at grinding the material and refining its grains.

Mechanical alloying is called "complete" if the final alloy is completely uniform, while it is called "partial" if chemical-physical differences can be identified in different areas of the same powder particle or between different particles: in this latter case, anyway, an intimate contact is obtained between the different components of the mix and usually a microstructure with refined grain. The mechanical alloying process for the production of powders permits obtaining alloys and microstructures otherwise impossible to achieve by means of normal melting methods inasmuch as the process always occurs in solid state and, therefore, alloys or compounds can be produced far from the condition of thermodynamic stability.

This process also permits obtaining supersaturated alloys or metal alloys immiscible the one with the other, and simplifying the production of alloys in the case of the elements having very different melting points.

A classic example consists of the aluminium-tungsten (Al—W) binary alloy: tungsten has a melting point above the boiling point of aluminium and consequently such alloy cannot be produced using traditional melting techniques despite such components being soluble in one another in both liquid and solid phases.

During the mechanical alloying process, it is crucial to control the balance between the welding and the fracturing of powder particles.

If the powder particles bind together too much, then they tend to form blocks or agglomerates that prevent process continuity and the chemical-physical uniformity of the powder.

If, instead, powder fracturing is preponderant with respect to welding, the risk is that of obtaining a powder which is too fine to the extent of becoming pyrophoric in the metallic case, or in any case with an apparent density too low for the classic use in the powder metallurgy sector.

Welding and fracturing depend on the type of mill and on all the mechanical alloying process parameters: type of loaded powder, quantity, weight ratio between milling bodies and powder, grinding temperature, grinding time, grinding energy, etc.

Cold welding, furthermore, can occur not only between the powder particles but also between the powder and the surfaces of the mill and of the balls; such phenomenon very much limits the use of the mechanical alloying process, because it makes it inefficient from an energy viewpoint, difficult to control and with low yield in terms of ratio between the powder introduced into the mill and the powder removed from it.

To control the balance between welding and fracturing, use is commonly made of special control agents, or "PCA substances" ("process control agent") or, more simply, "PCA".

The PCA substances are usually organic compounds, oils, alcohol, organic acids, graphite or water, which regulate or limit the cold welding phenomena.

Part of the elements in the PCA combine with the metallic powder to form dispersoids, carbides or oxides, and part of them have to be removed from the powder before the consolidation and sintering phases, penalty the formation of blistering (i.e., the formation of bubbles inside the material due to the expansion of a gas) and low end mechanical properties.

Take for example the mechanical alloying of an aluminium-based alloy: by simply introducing the aluminium powder and relative alloy elements inside the grinding mill, only after a short time a complete cold welding of the aluminium on the mill walls and on the grinding balls is inconveniently obtained.

A PCA substance therefore has to be used which in this case is usually stearic acid in the quantity of 1-2% in weight with respect to the total weight of the material being worked.

The use of stearic acid as PCA regulates the cold welding phenomena and permits mechanical alloying: at the end of the grinding process, part of the PCA substance is still present and a degassing operation has to be performed to remove the residues so as to achieve a good final microstructure and sintering.

The use of stearic acid results in any case in obtaining a final alloy with a far from negligible content of carbon and oxygen in the form of carbides and oxides as initial components of the PCA substance; the final alloy is therefore chemically "polluted".

Mechanical alloying is particularly problematic for all the alloys of the elements selected from the groups IV (titanium, zirconium and hafnium), V (vanadium, niobium, tantalum) and VI (chromium, molybdenum and tungsten) of the periodical table of elements, in particular those of group IV which have such a high reactivity that any commonly used PCA ends up introducing interstitial elements that are harmful for the obtained alloy.

In other words, the high chemical reactivity and the very high melting temperatures (from 1668° C. for titanium up to 3422° C. for tungsten) result in the alloys of these metals being produced with considerable difficulty by means of costly traditional manufacturing processes and methods.

For the alloys of the elements of group IV, e.g., starting with the relative purified oxide, the Kroll process or the Hunter process are used to obtain metal sponges of titanium, zirconium or hafnium; such sponges are the raw material for the subsequent melting processes required to eliminate the residues of chlorine, magnesium and sodium and to insert the alloy elements.

For the alloys of the elements of groups V and VI, instead, use is made of diverse thermochemical reactions which include aluminium-thermal reactions, reduction of oxides by means of hydrogen, reduction of oxides by means of carbon, use of potassium bi fluoride intermediates, etc., so as to obtain metallic powders subsequently sintered to obtain the final alloy.

The difficulty in producing these materials is increased by the fact that, to obtain high mechanical properties, especially tenacity, all the alloys of the above elements require a low level of interstitial elements, especially atoms of carbon, nitrogen, oxygen and sulphur which, if present, must be inconveniently removed.

As previously stated, the very need to obtain very low quantities of interstitial elements considerably prevents the adoption of the mechanical alloying method, in particular for alloys of titanium, zirconium, hafnium, vanadium, niobium and tantalum.

Such alloys are also very much affected by the cold welding phenomenon, which reduces the production output of the process and very much restricts the use of the mechanical alloying method for these materials, in some cases making it totally impossible if performed with common PCA.

In this respect, the patent document GB 2266097 proposes to use a certain quantity of tin as PCA substance for the mechanical alloying of titanium alloys.

DESCRIPTION OF THE INVENTION

The main aim of the present invention is to provide an alternative embodiment solution for a procedure for the mechanical alloying of metals, particularly of metals of groups IV, V, VI.

A further object of the present invention is to provide a procedure for the mechanical alloying of metals that permits obtaining metal alloys without passing through a melting stage, with considerable benefits both in energy and microstructural terms and a high production output.

Not the least object of the present invention is to provide a procedure for the mechanical alloying of metals that permits grinding the above metals, refining the grains and obtaining finished products with high mechanical properties.

Another object of the present invention is to provide a procedure for the mechanical alloying of metals which allows to overcome the mentioned drawbacks of the prior art in the ambit of a simple, rational, easy and effective to use as well as economic solution.

The above objects are achieved by the present procedure for the mechanical alloying of metals, comprising grinding at least a metal inside a grinding mill together with at least a control agent to obtain a powdered ground product, characterized in that:

said metal is selected from the list comprising: titanium, zirconium, hafnium, vanadium, niobium, tantalum, chromium, molybdenum, tungsten; and said control agent is selected from the list comprising: magnesium, calcium and rare earths.

BRIEF DESCRIPTION OF THE DRAWINGS

Other characteristics and advantages of the present invention will become more evident from the description of some preferred, but not exclusive, embodiments of a procedure for the mechanical alloying of metals, illustrated below with the aid of the accompanying table of drawings in which:

FIG. 1 is a photomicrography of an example of a product obtained through the procedure according to the invention;

FIG. 2 is a photomicrography of another example of a product obtained through the procedure according to the invention.

EMBODIMENTS OF THE INVENTION

The present procedure envisages to grind one or more metals selected from the groups IV (titanium, zirconium and hafnium), V (vanadium, niobium, tantalum) and VI (chromium, molybdenum and tungsten) of the periodical table of elements inside a grinding mill.

Usefully, before grinding, the metal is in the form of a sponge, which is reduced to a powder state during grinding, or in the form of powder aggregate, as can be obtained e.g. from the well-known Armstrong or Metalysis processes.

After grinding, the powder thus obtained is ready to be subsequently used in traditional forming, compacting and sintering methods (e.g., using the known SPS—Spark Plasma Sintering—method).

The possibility of using the metal in the form of a sponge represents a huge advantage from an economical viewpoint; with reference to titanium, e.g., the titanium sponge costs about ⅙ that of commercial titanium powder, and similar considerations also hold true for the zirconium sponge.

It is therefore easy to understand that the procedure according to the present invention is particularly cost effective when the metal, before grinding, is titanium sponge or zirconium sponge.

In this case, in fact, the synergy between the choice of initial material and the mechanical alloying method permits obtaining a highly efficient and particularly competitive procedure from an economic viewpoint with respect to traditional methods.

The present invention can, in any case, also be used when the initial metal is in other forms, e.g., already in the form of powder and also in the form of hydride, e.g. titanium hydride (TiH2), zirconium hydride (ZrH2) and hafnium hydride (HfH2).

The grinding mill can consist, e.g., of a jar or other vessel containing the material to be treated, which is made to rotate or subject to any other movement able to set in motion the material to be treated inside it.

Preferably, grinding occurs by means of loose grinding bodies inside the grinding mill; the loose grinding bodies, e.g., consist of tempered-steel balls. Furthermore, grinding occurs in a controlled atmosphere.

The atmosphere in which mechanical alloying takes place is very important because it must not pollute the product ground into powder obtained at the end of grinding.

In practice, the controlled atmosphere consists in an inert gas such as argon or another noble gas, or in a condition of high vacuum, in which case a jar must be made from which it is possible to remove the air.

The presence of vacuum in the jar promotes cold welding phenomena, but has the advantage of not polluting the powder with any gas and ensuring a greater ball impact speed.

Inside the mill, the metal is ground together with at least a control agent which regulates and/or limits the fracture and cold welding phenomena which occur during grinding, to obtain a powdered ground product.

The control agent is selected from the list comprising: magnesium, calcium and rare earths.

According to the IUPAC (International Union of Pure and Applied Chemistry) organization, rare earths are the elements scandium, yttrium and all the lanthanides (lanthanum, cerium, praseodymium, neodymium, promethium, samarium, europium, gadolinium, terbium, dysprosium, holmium, erbium, thulium, ytterbium and lutetium).

In other words, therefore, the control agent is an element selected among magnesium, calcium, scandium, yttrium, lanthanum, cerium, praseodymium, neodymium, promethium, samarium, europium, gadolinium, terbium, dysprosium, holmium, erbium, thulium, ytterbium and lutetium.

The use of such elements as control agent determines the trapping of the oxygen naturally present in the original metal to form oxides, of the MgO, CaO or RExOy type by "scavenger effect".

Furthermore, the use of magnesium, calcium or rare earths permits fixing the chlorine (often present as production residue of metal sponges) in oxychlorides of the (Mg, Ca,RE)-O—Cl type.

In both cases, the trapping of oxygen and chlorine improves the end characteristics of the ground product and prevents having to remove the control agent once mechanical alloying has terminated; the oxides and the oxychlorides formed by the control agent according to the invention do in fact remain stably inside the ground product.

All the elements to be used as control agent, furthermore, are insoluble in solid phase in the elements of the groups IV, V, VI mentioned before, show high cold welding adjustment capacity and make it possible to carry out the mechanical alloying operation in vacuum.

Furthermore, the use of magnesium, calcium and/or rare earths permits using metal sponges instead of powders as original material to be mechanically alloyed, and this, as explained earlier, makes the process economically very advantageous.

Preferably, the control agent is selected from the list comprising: calcium and rare earths.

Even more preferably, the control agent is calcium or yttrium.

From the point of view of the subsequent sintering operations which the ground product must undergo after grinding, yttrium is the best element to be used, taking into account its strong affinity with oxygen and its high melting point, and this prevents the possible formation of liquid phases and/or sublimation in high vacuum during sintering.

Calcium however behaves better during mechanical alloying, because it ensures a higher production output, i.e., it makes grinding more efficient even when present in small quantities.

The grinding phase of the metal and of the control agent inside the grinding mill can occur together with other alloy components, so as to obtain an alloy in powder state in which the atoms of metal and other alloy components are intimately bonded together.

The grinding of the metal and of the control agent inside the grinding mill can also be done without other alloy components, in which case, the mechanical alloying process is aimed at grinding the metal and refining its grains.

Before the grinding phase, the control agent can be in pure state and can be introduced inside the mill separately from the metal and from the other alloy elements.

It is however possible that before the grinding phase, the control agent finds itself bonded to one or more of the other alloy components to form a so-called "master alloy".

In other words, the control agent can be introduced inside the grinding mill both in pure state and in the form of master alloy.

Examples of master alloy are: CrY (50 wt % of chromium and 50 wt % of yttrium), SiY (50 at % of silicon and 50 at % of yttrium), CaEr (50 at % of calcium and 50 at % of erbium).

During grinding, the metal, the control agent and the other alloy components are present in the following weight concentrations with respect to the total weight of the ground product:

| | |
|---|---|
| metal | 30-99.95% |
| control agent | 0.05-10% |
| other alloy components | 0-69.95% |

Preferably, nevertheless, during grinding the control agent is present in the following weight concentration with respect to the total weight of the ground product:

| | |
|---|---|
| Control agent | 0.05-2% |

Example 1

To describe the invention in detail, an example is shown of the mechanical alloying of a titanium powder and of a master alloy of aluminium and vanadium (Al—V) to obtain the well-known alloy Ti6Al4V.

For this purpose, a planetary mill has been used with jar and tempered-steel balls.

At disposal was a pure titanium powder with grain size below 150 μm and a master alloy Al—V (60 wt % Aluminium and 40 wt % Vanadium) with grain size below 250 μm.

The titanium powder had an oxygen content of 0.13 wt % while that of the master alloy was 0.15 wt %; the oxygen content is mentioned here because the oxygen, just like the other interstitials carbon, sulphur and nitrogen, is an element to be limited as much as possible in obtaining the alloy Ti6Al4V.

90 g of titanium powder and 10 g of Al—V were loaded into the planetary mill jar to obtain the alloy Ti6Al4V.

Keeping the grinding parameters constant (size and quantity of balls, jar type, rotation speed, etc.) various mechanical alloying operations were performed, varying the control agent content, the type of atmosphere in the jar and the grinding time.

As control agent, calcium powder was chosen with grain size below 300 μm and various tests were performed with a quantity of calcium equal to 0 wt %, 0.125 wt %, 0.250 wt % and 0.500 wt % compared to the total material being ground.

The maximum alloying time was 2.5 hours: at 0.5 hour intervals, the powder obtained until that time was taken out and this was sifted to collect up the quantity of powder of size below 200 μm.

The percentage of powder thus recovered with respect to the total percentage defines the grinding yield and points to the evolution of the process.

The following Table 1 shows the data obtained from five distinct process conditions.

TABLE 1

| | 0.5 h | 1.0 h | 1.5 h | 2.0 h | 2.5 h |
|---|---|---|---|---|---|
| Test A: argon/no PCA | 48% | 8% | CW | CW | CW |
| Test B: vacuum/no PCA | CW | CW | CW | CW | CW |
| Test C: vacuum/0.125 wt % Ca | 100% | 99% | 98% | 98% | 97% |
| Test D: vacuum/0.250 wt % Ca | 100% | 100% | 99% | 99% | 98% |
| Test E: vacuum/0.500 wt % Ca | 100% | 100% | 99% | 99% | 99% |

Test A was performed in an argon atmosphere and in the absence of control agent.

Test B was performed in conditions of high vacuum and in the absence of control agent.

Test C was performed in conditions of high vacuum with 0.125 wt % of calcium.

Test D was performed in conditions of high vacuum with 0.250 wt % of calcium.

Test E was performed in conditions of high vacuum with 0.500 wt % of calcium. A comparison of the results of Tests A and B shown on the table clearly indicates how the vacuum produces the easier occurrence of cold welding phenomena.

In Test A in fact, in the total absence of control agent, the powder being ground adhered soon in large quantities to the balls and to the sides of the jar, but it was in any case possible to extract about 48% of powder with grain size below 200 μm after the first half hour, and about 8% after the first hour, a condition of complete cold welding (indicated by CW on Table 1) only occurring at the third opening after an hour and a half.

In Test B, on the other hand, already after just 30 minutes of grinding, a condition of complete adhesion of the powder to the balls and to the sides of the jar occurred.

Tests C, D and E, also clearly show that the use of calcium as control agent, including in small quantities, fully eliminates or postpones very much the cold welding phenomenon, even after 2.5 hours of grinding.

Micro-structural analyses have shown how, in the presence of calcium, one and a half hours are already enough to achieve chemical/micro-structural uniformity, and that the final powder obtained after opening the jar to the air has an oxygen content of 0.18 wt %.

Such oxygen value is slightly higher than that of the original powder and is produced by the opening of the jar to the air.

Whereas, according to the ASTM B319 standard, the maximum oxygen content for the Ti6Al4V alloy is 0.20 wt %, the fact that after opening to the air, the powdered ground product had an oxygen content below that required is very positive because it permits avoiding the use of systems in vacuum or protective atmosphere during the subsequent powder manipulating and compacting phases. The ground powders of tests C, D and E, ground for 1.5 hours, were sintered by means of Spark Plasma Sintering (SPS) at 1100° C. and 30 MPa for 1 minute. Subsequently, the sintered samples underwent a heat treatment at 1250° C. for one hour in a high-vacuum metal oven.

FIG. 1 shows the photomicrography of the sample obtained from Test D in which small precipitates of CaO can be seen a few microns in size which indicate the calcium is able to trap the oxygen of the surrounding matrix; such phenomenon is possible thanks to the low solubility of the calcium in the titanium in solid state and to the greater affinity of the calcium with the oxygen with respect to the titanium.

From what can be seen in FIG. 1, furthermore, it will be noticed that the size of the crystalline grain of the Ti6Al4V alloy is very small despite the material having been treated at very high temperature, which shows the superior micro-structural quality obtained thanks to the procedure according to the invention.

The powder of Test D obtained after 1.5 hours of grinding was used to fabricate, by means of sintering and heat treatment, some tensile samples with the following mechanical properties:

Elastic load: $\sigma Y$=850 MPa

Ultimate tensile strength: UTS=980 MPa

Deformation: $\epsilon f$=11%

Such properties fully satisfy the standards of the classic Ti6Al4V alloy.

Example 2

Mechanical alloying was performed on 90 g of titanium sponge of size between ⅛ of an inch and ¾ of an inch (with an oxygen content of 0.08 wt %) and 10 g of master alloy Al—V (60 wt % aluminium and 40 wt % vanadium) in the form of powder with grain size below 250 μm.

As control agent 0.25 g of calcium was used.

Grinding was performed in vacuum for 1.5 hours using a planetary mill.

After such time, 97% of powder was recovered with grain size below 200 μm and with an oxygen content of 0.12 wt %.

After sintering and heat treatment, the microstructure and mechanical properties of the material showed themselves slightly lower than those of EXAMPLE 1 but in any case of good level.

The advantage of such powdered ground product is economical inasmuch as obtained starting with titanium sponge which, as has been said, costs much less that titanium powder.

Example 3

100 g of titanium sponge were ground of size between ⅛ of an inch and ¾ of an inch (with an oxygen content of 0.08 wt %) and 0.25 g of calcium as control agent.

Grinding was performed in vacuum for 2 hours using a planetary mill.

After such time, 97% of powder was recovered with grain size below 200 μm and with an oxygen content of 0.16 wt %.

The powder ground this way was sintered by means of SPS at 1000° C. and 30 MPa for 1 minute and then heat treated at 1250° C. for one hour in a high vacuum metallic oven.

The following mechanical properties were obtained:

Elastic load: $\sigma Y$=615 MPa

Ultimate tensile strength: UTS=700 MPa

Deformation: $\epsilon f$=14%

The titanium thus obtained presented a particularly refined crystalline grain as shown by the fact that, though having a higher oxygen content, it has mechanical properties superior to those of Grade 4 titanium alloy, which has an oxygen content of 0.4 wt %.

Example 4

Mechanical alloying was performed on 50 g of titanium sponge of size between ⅛ of an inch and ¾ of an inch (with an oxygen content of 0.08 wt %) with 2 g of a master alloy of chromium and yttrium CrY (50 wt % chromium and 50 wt % yttrium) so as to obtain the final alloy Ti2Cr2Y.

In such a case, the master alloy acts as carrier of the control agent, i.e. yttrium.

The master alloy has been introduced in the grinding mill in the form of drilling shavings.

Grinding was performed in vacuum for 2 hours using a planetary mill.

After such time, 96% of powder was recovered with grain size below 200 μm and with an oxygen content of 0.10 wt %.

The powder ground this way was sintered by means of SPS at 1250° C. and 30 MPa for 5 minutes.

After sintering, the microstructure was homogeneous with a grain size of approx. 2 μm.

Tensile mechanical tests showed the following mechanical properties:

Elastic load: σY=715 MPa

Ultimate tensile strength: UTS=790 MPa

Deformation: εf=18%

Example 5

Mechanical alloying was performed on 50 g of titanium sponge of size between ⅛ of an inch and ¾ of an inch (with an oxygen content of 0.08 wt %) with 2 g of a master alloy of silicon and yttrium SiY (50 wt % silicon and 50 wt % yttrium) so as to obtain the final alloy Ti2Si2Y.

Like in the previous example, the master alloy acts as carrier of the control agent, i.e. yttrium and has been introduced in the system in the form of drilling shavings.

Grinding was performed in vacuum for 2 hours using a planetary mill.

After such time, 96% of powder was recovered with grain size below 200 μm and with an oxygen content of 0.10 wt %.

The powder ground this way was sintered by means of SPS at 1000° C. and 30 MPa for 1 minute.

After an operation of annealing at 900° C. for 2 hours, the final alloy showed precipitates rich in yttrium and Y2O3 of submicron dimensions that make it particularly resistant to creep and therefore suitable for aeronautical and aerospace applications.

Example 6

Mechanical alloying was performed on 90 g of c.p. titanium powder of Grade 1 with grain size below 150 μm, 5 g of tin powder with grain size below 75 μm, 3 g of carbon black and 2 g of powdered shavings of a master alloy of chromium and yttrium CrY (50 wt % chromium and 50 wt % yttrium).

Grinding was performed in vacuum for 1.5 hours using a planetary mill.

After such time, 99% of powder was recovered with grain size below 100 μm, which was sintered by means of SPS at 1150° C. and 30 MPa for 3 minutes.

The microstructure illustrated in FIG. 2 was obtained in this way, which shows a so-called "Metal Matrix Composite" based on titanium with more than 20% by volume of titanium carbide TiC.

The microstructure is very homogeneous and has hardness equal to 380 HV10.

Thanks to the uniformity of the microstructure, to the effect of substitutional hardening of tin and to the particularly refined microstructure, the tensile tests showed excellent values equal to:

Elastic load: σY=955 MPa

Ultimate tensile strength: UTS=1100 MPa

Deformation: εf=5%

Example 7

Mechanical alloying was performed on 52 g of titanium sponge, 35 g of niobium powder with grain size of 60 mesh (Tyler scale), 5.7 g of tantalum powder with grain size below 100 μm, 7.3 g of zirconium sponge and 0.125 g of calcium powder as control agent, in order to obtain the well-known final alloy TNTZ (Ti35Nb5.7Ta7.3Zr) which, as known, is a very complex and expensive alloy if produced by traditional methods.

Grinding was performed in vacuum for 2.5 hours using a planetary mill.

After this time 98% of powder was recovered with grain size below 250 μm.

The X-ray analysis of powder showed the almost exclusive presence of titanium in the β phase and the total absence of pure elements.

Example 8

92 g of zirconium sponge were ground of size between ⅜ of an inch and % of an inch (with an oxygen content of 0.09 wt %) together with 8 g of calcium powder acting as control agent.

Grinding was performed in vacuum for 10 hours using a planetary mill.

After such time, 98% of powder was recovered with grain size below 200 μm.

The powder thus ground was sintered by means of SPS at 1200° C. and 30 MPa for 1 minute to obtain a disc with a diameter of 20 mm and a height of 7 mm.

The disc was polished on both bases and placed in an air oven at 600° C. for 2 hours; the purpose for such heat treatment was to replicate the well-known commercial product OXINIUM® by the company Smith & Nephew.

Thanks to the reduced dimensions of crystalline grains, the zirconium oxide appeared continuous and solid.

At the end of the heat treatment, the oxidized surfaces were analyzed using X rays and appeared made up of stabilized zirconium.

This derives from the conversion of the zirconium and calcium into ZrO2(CaO), determining the known phenomenon of the stabilization of cubic zirconia, including at ambient temperature, considering the high calcium content.

Stabilization is provided by the presence of the control agent (whether Calcium, Magnesium or Yttrium) in large quantities because, after grinding, zirconium supersaturated with control agent is obtained which, during the subsequent oxidization, is converted at the same time as the zirconium.

Example 9

Mechanical alloying was performed on 63.95 g of titanium sponge, 36.05 g of aluminium powder with grain size of 16 mesh (Tyler scale) and 1 g of erbium powder as control agent to form the composition of titanium aluminide TiAl (Ti-50at % Al).

Grinding was performed in vacuum for 2.5 hours using a planetary mill.

After this time 98% of powder was recovered with grain size below 250 μm.

The X-ray analysis of the powder showed the exclusive presence of the main peak of α titanium and the total absence of the peaks relating to aluminium and erbium.

Example 10

Mechanical alloying was performed on 44.72 g of titanium sponge, 55.28 g of highly pure nickel powder and 0.25 g of calcium powder used as control agent to form the composition Ti-50.2at % Ni.

As is known, the alloy of such composition features properties of shape memory and super-elasticity.

Grinding was performed in vacuum for 2.5 hours using a planetary mill.

After this time 98% of powder was recovered with grain size below 250 μm.

The X-ray analysis of the powder showed the absence of peaks relating to the nickel to confirm mechanical alloying.

The invention claimed is:

1. A procedure for the mechanical alloying of metals, comprising grinding at least a metal inside a grinding mill together with at least a control agent to obtain a powdered ground product, wherein:

said metal is selected from the group consisting of: titanium, zirconium, hafnium, vanadium, niobium, tantalum, molybdenum, tungsten;

said control agent is selected from the group consisting of: calcium and rare earths; and before said grinding, said control agent is in pure state.

2. The procedure according to claim 1, wherein said grinding comprises grinding said metal and said control agent inside said grinding mill together with other alloy components.

3. The procedure according to claim 2, wherein, during said grinding, said metal, said control agent and said other alloy components are present in the following weight concentrations with respect to the total weight of said ground product:

| | |
|---|---|
| metal | 30-99.95%; |
| control agent | 0.05-10%; and |
| other alloy components | 0-69.95%. |

4. The procedure according to claim 1, wherein, during said grinding, said control agent is present in the following weight concentration with respect to the total weight of said ground product:

| | |
|---|---|
| control agent | 0.05-2%. |

5. The procedure according to claim 1, wherein said control agent is calcium.

6. The procedure according to claim 1, wherein said control agent is yttrium.

7. The procedure according to claim 1, wherein, before said grinding, said metal is in the form of powder aggregates.

8. The procedure according to claim 1, wherein, before said grinding, said metal is in the form of hydride.

9. The procedure according to claim 1, wherein said metal is titanium.

10. The procedure according to claim 1, wherein said metal is zirconium.

11. The procedure according to claim 1, wherein said grinding occurs by means of loose grinding bodies present inside said grinding mill.

12. The procedure according to claim 1, wherein said grinding occurs in a controlled atmosphere.

13. A procedure for the mechanical alloying of metals, comprising grinding at least a metal inside a grinding mill together with at least a control agent to obtain a powdered ground product, wherein:

said metal is selected from the group consisting of: titanium, zirconium, hafnium, vanadium, niobium, tantalum, molybdenum, tungsten;

said control agent is selected from the group consisting of: calcium and rare earths;

said grinding comprises grinding said metal and said control agent inside said grinding mill together with other alloy components; and before said grinding, said control agent is bonded to said other alloy components.

14. The procedure according to claim 13, wherein said metal is titanium.

15. The procedure according to claim 13, wherein said grinding occurs by means of loose grinding bodies present inside said grinding mill.

16. A procedure for the mechanical alloying of metals, comprising grinding at least a metal inside a grinding mill together with at least a control agent to obtain a powdered ground product, wherein:

said metal is selected from the group consisting of: titanium, zirconium, hafnium, vanadium, niobium, tantalum, molybdenum, tungsten;

said control agent is selected from the group consisting of: calcium and rare earths; and before said grinding, said metal is in the form of a sponge.

17. The procedure according to claim 16, wherein said metal is titanium.

18. The procedure according to claim 16, wherein said grinding occurs by means of loose grinding bodies present inside said grinding mill.

* * * * *